US006823636B2

(12) United States Patent
Mahoney

(10) Patent No.: US 6,823,636 B2
(45) Date of Patent: Nov. 30, 2004

(54) TILE WITH EXPANDING BACKING SYSTEM

(76) Inventor: Thomas M. Mahoney, 7958 Royal Birkdale Cir., Bradenton, FL (US) 34202

( * ) Notice: Subject to any disclaimer, the term of this patent is extended or adjusted under 35 U.S.C. 154(b) by 60 days.

(21) Appl. No.: 10/374,231

(22) Filed: Feb. 25, 2003

(65) Prior Publication Data

US 2004/0163344 A1 Aug. 26, 2004

(51) Int. Cl.[7] ..... E04F 13/08

(52) U.S. Cl. ..... 52/384; 52/670; 52/385; 52/386

(58) Field of Search ..... 52/670, 384, 385, 52/386, 387, 388, 389

(56) References Cited

U.S. PATENT DOCUMENTS

| | | | | | |
|---|---|---|---|---|---|
| 460,542 | A | * | 9/1891 | Stephanie | 52/670 |
| 889,312 | A | * | 6/1908 | Kahn | 52/670 |
| 1,314,107 | A | * | 8/1919 | Waller | 52/670 |
| 3,077,059 | A | * | 2/1963 | Stout | 52/388 |
| 3,740,911 | A | | 6/1973 | O'Leary | |
| 3,775,918 | A | * | 12/1973 | Johnson | 52/155 |
| 4,450,664 | A | | 5/1984 | McNamee | |
| 4,590,731 | A | | 5/1986 | DeGooyer | |
| 4,888,928 | A | | 12/1989 | Rea et al. | |
| 4,920,716 | A | * | 5/1990 | Coffey | 52/386 |
| 4,921,741 | A | | 5/1990 | Mullen | |
| 5,238,721 | A | | 8/1993 | Nakazawa | |
| 5,323,575 | A | | 6/1994 | Yeh | |
| 5,325,652 | A | * | 7/1994 | Feder | 52/746.12 |
| 5,333,430 | A | | 8/1994 | Vidal | |
| 5,418,036 | A | | 5/1995 | Tokikawa et al. | |
| 5,568,391 | A | | 10/1996 | Mckee | |
| 5,993,107 | A | * | 11/1999 | Bauer | 404/43 |
| 6,151,854 | A | | 11/2000 | Gutjahr | |
| 6,185,893 | B1 | * | 2/2001 | Gaston | 52/385 |

* cited by examiner

*Primary Examiner*—Kimberly Wood
(74) *Attorney, Agent, or Firm*—Charles J. Prescott

(57) ABSTRACT

A tile and backing assembly for creating a walkway, pathway and a driveway atop ground. Each assembly used in constructing the walkway preferably includes a backing member formed from a single sheet having elongated tile support members positioned side-by-side one to another. Each tile support member is defined by spaced apart transverse slits or cuts through the backing member, each having complete and incomplete segments and extending in zigzag fashion thereacross. Each of the incomplete segments is defined by overlapping unconnected spaced slit segments to define a slender elongated expansion link connecting adjacent tile support members together. Each of the tile support members have evenly spaced tile attachment areas, each of which supportively receive one of a plurality of tiles. Each tile is attached to one tile attachment area in a desired design array with adjacent tiles abutting one another when the assembly is in the contracted orientation. The assembly is deployable atop the ground by pulling end margins thereof apart to expand the backing member in length whereby the tiles form a desired spaced apart expanded array atop the ground.

4 Claims, 15 Drawing Sheets

Expanded

Contracted

Expanded

Contracted

Expanded

Contracted

Expanded

Contracted

Expanded

Contracted (Expanded)

(Contracted)

EXPANDED

CONTRACTED

FIG 16
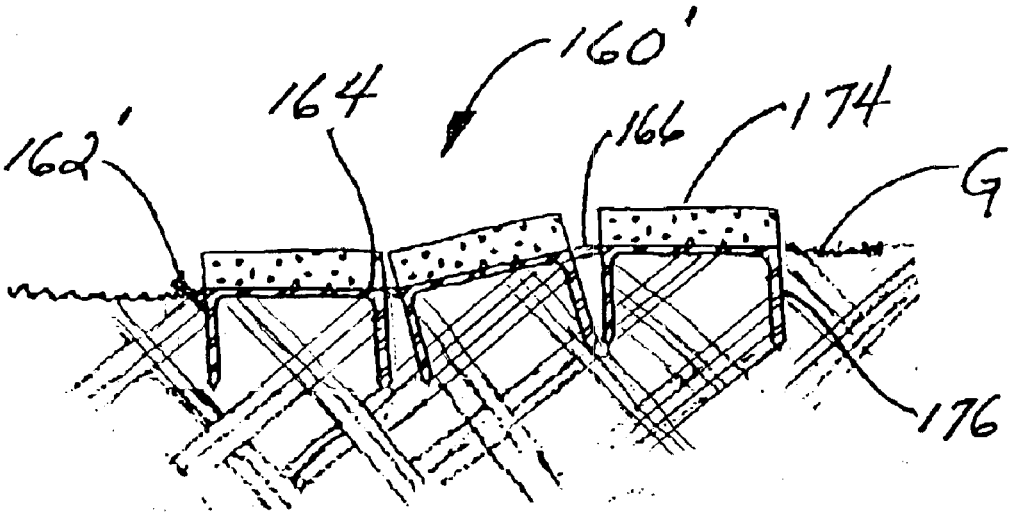
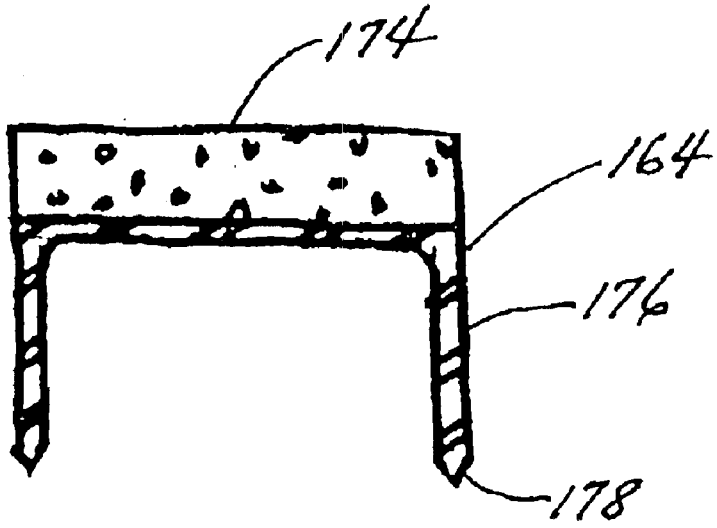
FIG 17

EXPANDED

CONTRACTED

TILE WITH EXPANDING BACKING SYSTEM

CROSS-REFERENCE TO RELATED APPLICATIONS

None

STATEMENT REGARDING FEDERALLY SPONSORED RESEARCH OR DEVELOPMENT

None

INCORPORATION-BY-REFERENCE OF MATERIAL SUBMITTED ON A COMPACT DISC

None

BACKGROUND OF THE INVENTION

This invention relates generally to the construction of walkways and golf cart pathways, and more particularly to a tile or brick and backing assembly for more easily and economically constructing a more naturally aesthetic walkway, golf cart pathway or driveway.

Asphalt has become the preferred mode or constructing a walkway or a golf cart pathway or light duty driveway along and adjacent to fairways between successive tees. Alternately, such pathways may also be constructed of poured concrete or individual bricks or tiles which are laid atop the ground one at a time in a desired array. All of these prior art forms of constructing such walkways and pathways are expensive and skilled labor intensive with respect to materials and equipment required for such construction. Moreover, a continuous strip of black asphalt is aesthetically incompatible in a lush forest-like setting of a golf course fairway.

A number of prior art patents teach various forms of constructing driveways, walkways and pathways as follows:

U.S. Pat. No. 4,450,664 to McNamee

U.S. Pat. No. 4,921,741 to Mullen

U.S. Pat. No. 5,333,430 to Vidal

U.S. Pat. No. 5,418,036 to Tokikawa et al.

U.S. Pat. No. 5,568,391 to Mckee

U.S. Pat. No. 5,323,575 to Yeh

U.S. Pat. No. 4,888,928 to Rea et al.

U.S. Pat. No. 3,740,911 to O'Leary

U.S. Pat. No. 4,590,731 to DeGooyer

U.S. Pat. No. 6,151,854 to Gutjahr

U.S. Pat. No. 5,238,721 to Nakazawa

However, these complex prior art patents emphasize the expense of these concepts of creating a pathway or walkway made of tile or brick or constructed in situ.

The present invention provides a prefabricated system for the easy deployment of a tile or brick pathway or walkway atop the ground or other substrate which is both economical to manufacture and economically deployable in such a fashion that the pathway may also be variably expanded with respect to adjacent tile or brick and arcuately or linearly contoured to follow an edge of a fairway or walkway path in almost any desired configuration. Moreover, by the means of expansion of the array of tile or brick during deployment, the variable spaces or gaps between each of the adjacent tile or brick may be either filled with decorative material such as gravel, sand, shell or sod or simply seeded with grass and allowed to grow up and fill in these expansion gaps for a more natural appearance of the completed pathway.

BRIEF SUMMARY OF THE INVENTION

This invention is directed to a tile and backing assembly for creating a walkway, pathway and a driveway atop ground or other substrates. Each assembly includes a backing mat or member preferably formed from a single sheet having tile support members positioned side-by-side one to another. The tile support members are preferably formed by spaced apart transverse slits or cuts through the backing mat, each slit or cut having complete and incomplete segments and extending in zigzag fashion across the width of the backing mat. Each of the incomplete segments is defined by overlapping spaced unconnected slit segments to define a slender elongated expansion link connecting adjacent tile support members together. Each tile is attached to one tile attachment area in a desired design array with adjacent tiles abutting one another. Each assembly is deployed atop a substrate or ground and, by then pulling end margins thereof apart to expand the backing mat in length up to a limit of length and elasticity of the expansion links, the tiles form a desired spaced apart expanded array atop the substrate.

It is therefore an object of this invention to provide a tile or brick and backing mat assembly which is prefabricated before transport to the deployment site, there expanded and positioned or connected in end-to-end fashion to other assemblies to form a pathway or walkway along a subsurface such as ground.

It is another object of this invention to provide a unique pathway or walkway construction which, when completed, natural materials or growth will occur between the expanded tile or brick to provide a more attractive alternative to a continuous asphalt pathway.

It is still another object of this invention to provide a tile or brick and backing assembly for constructing a walkway or a golf cart pathway which is easily contourable with prefabricated sections deployed in end-to-end fashion to form the pathway or walkway.

Yet another object of this invention is to provide a system for constructing walkways, pathways and driveways which affords easier and more economical installation by being geared toward the utilization of unskilled laborers and conventional tools and implements for its deployment.

Still another object of this invention is to provide walkways and pathways along a golf course fairway which provide golf ball bounce and roll characteristics similar to those of the fairway itself.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIGS. 1A and 1B to FIGS. 5A and 5B depict top plan views of a variety of decorative embodiments of the invention each shown in the contracted and the deployed orientation atop a substrate absent the backing mat for simplicity.

FIG. 16 is a vertical cross section view of a portion of the invention of FIG. 15 expanded and deployed atop the ground.

FIG. 17 is a section view in the direction of arrows 17—17 in FIG. 14.

DETAILED DESCRIPTION OF THE INVENTION

Figure 1B:
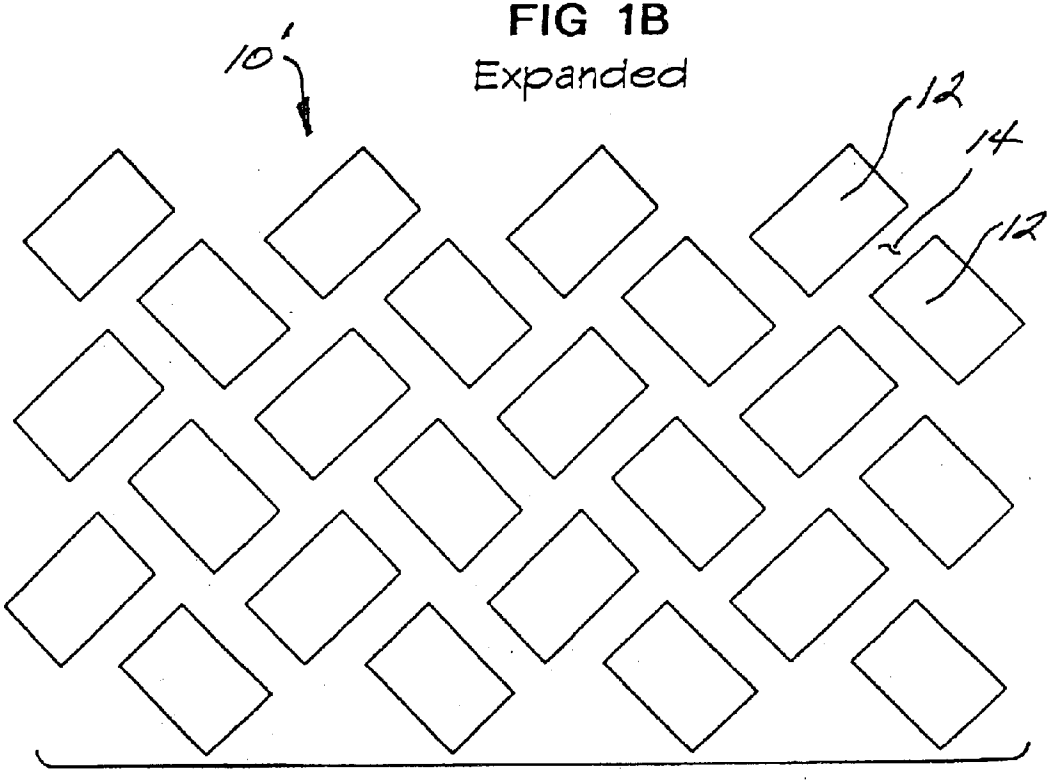

Referring now to the drawings, the broad concept of the general invention is shown in FIGS. 1A and 1B to FIGS. 5A to 5B. In FIGS. 1A to 5A, these embodiments of the invention are shown in their contracted configuration at 10, 16, 20, 30 and 36. Each of these embodiments includes a plurality of tile or brick members 12, 18/20, 26, 32 and 38 which are arranged in various decorative design forms as shown as a matter of design choice by example.

In FIGS. 1B to 5B, each of these embodiments is shown deployed in the expanded position generally at 10', 16', 24', 30' and 36'. For clarity, the backing mat or member which supports and connects the tile members 12, 18/20, 26, 32 and 38 is not shown. In the expanded or deployed orientation, which would occur atop a subsurface such as ground, the tiles are spaced apart by a variably sized gap shown at 14, 22, 28, 34, and 40, respectively. These gaps are then filled in with dirt, sod, a decorative crushed stone, gravel, shell or allowed to simply be overgrown by vegetation as desired.

The important aspect of the present invention therefore is to create a pathway, walkway or driveway with the expanded brick or tile deployed atop the ground in a spaced apart arrangement of the individual tiles or brick so that vegetation or other decorative fill material may be allowed to grow or be spread in these gaps for enhanced decorative and aesthetic features of the pathway.

Preferred Embodiment

Figures 6A, 6B:
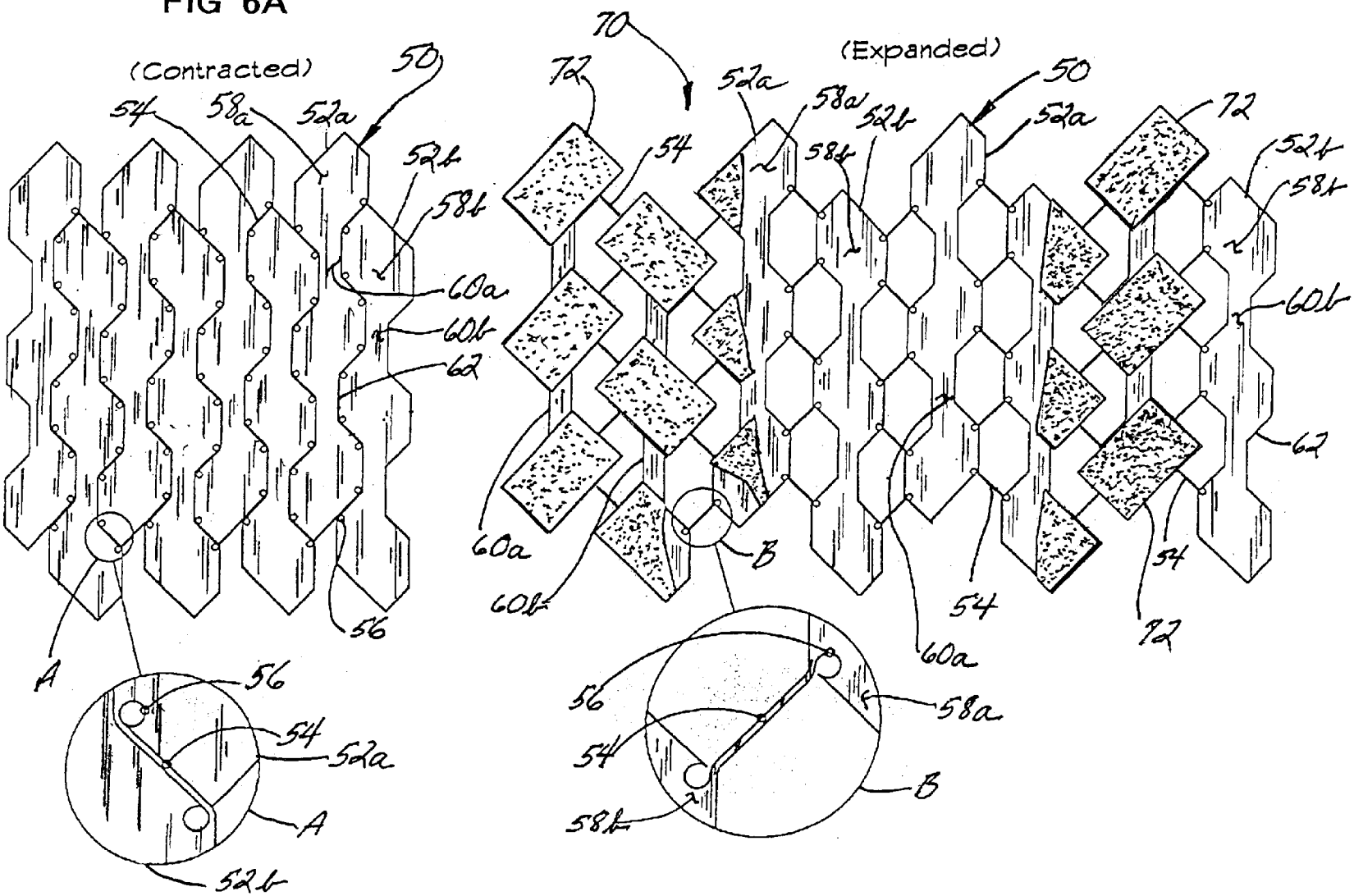
FIGS. 6A and 6B show the preferred embodiment of the invention, including the preferred backing mat in the contracted and expanded configurations.
Figure 6C:
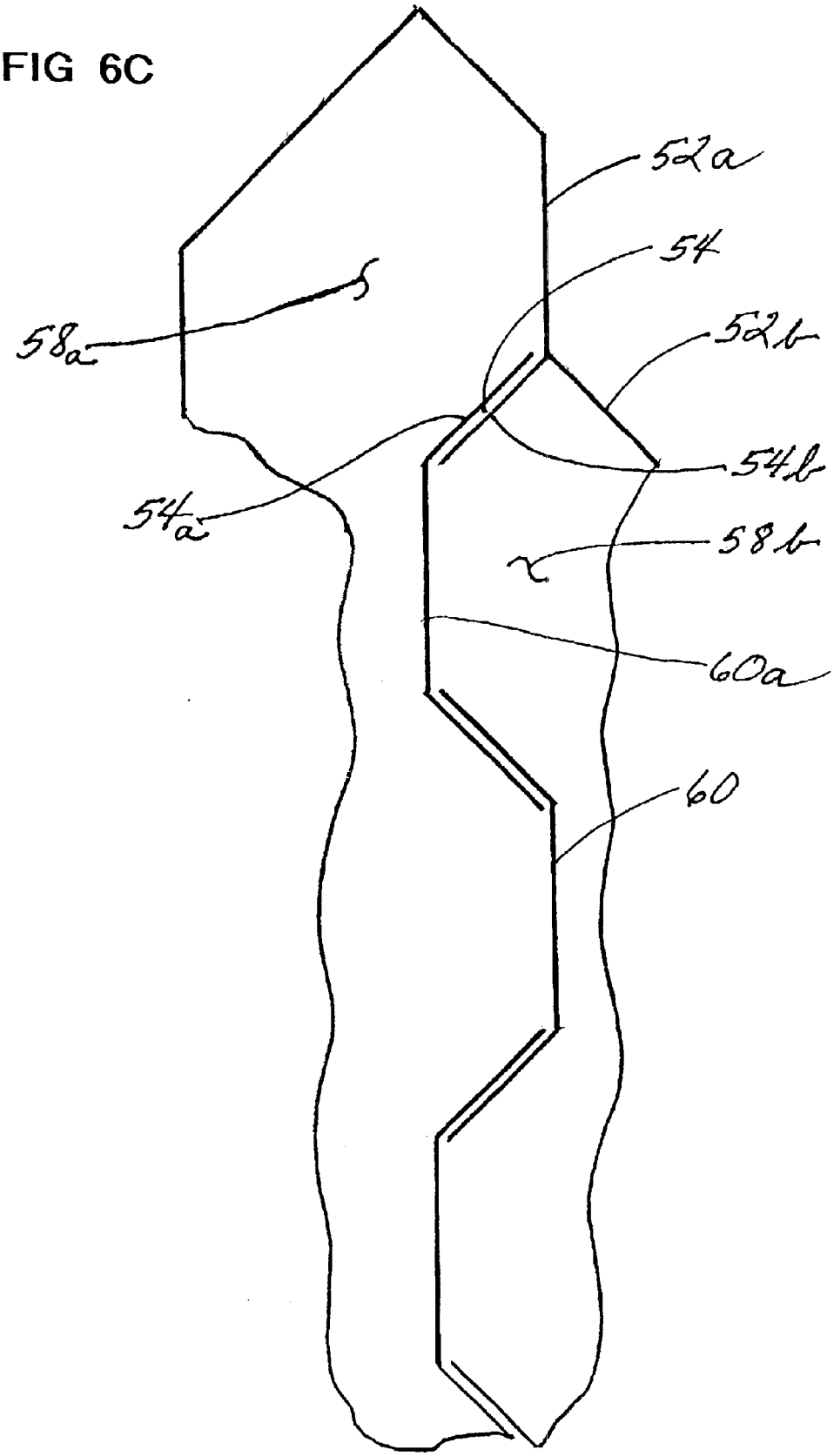
FIG. 6C is an enlargement of a portion of FIG. 6A.

Referring now to FIGS. 6A, 6B and 6C, the preferred embodiment of a backing mat of the invention is shown generally at numeral 50 in these figures, while the expanded or deployed embodiment of the tile and backing assembly combined is shown generally at numeral 70 in FIG. 6B. The contracted backing mat 50 in FIG. 6A is formed of a single sheet of flexible or semi-rigid material of a preferably non-metallic and non-corrosive material having a thickness in the range of ⅛" to ¼". Such materials as sheet plastic, polyethylene, polyurethane, polypropylene and the like are examples of materials to be selected within the scope of this invention.

Figure 1A:
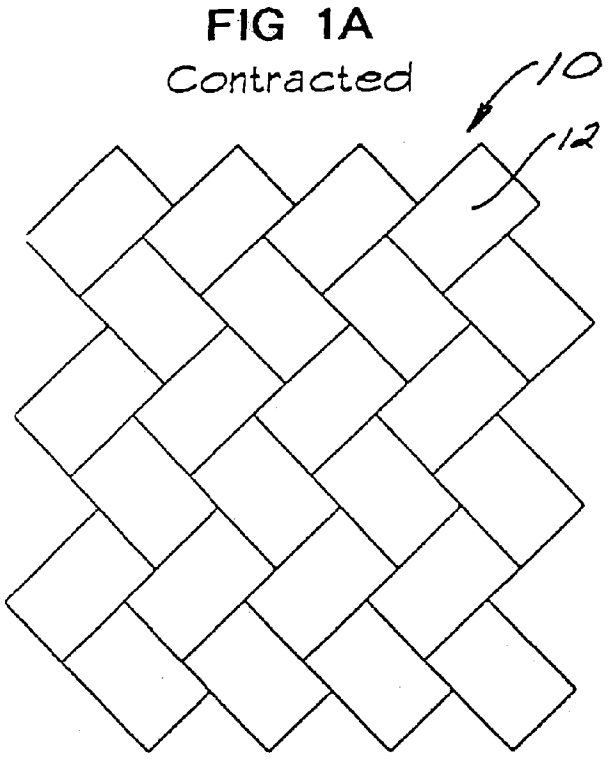
Figure 2B:
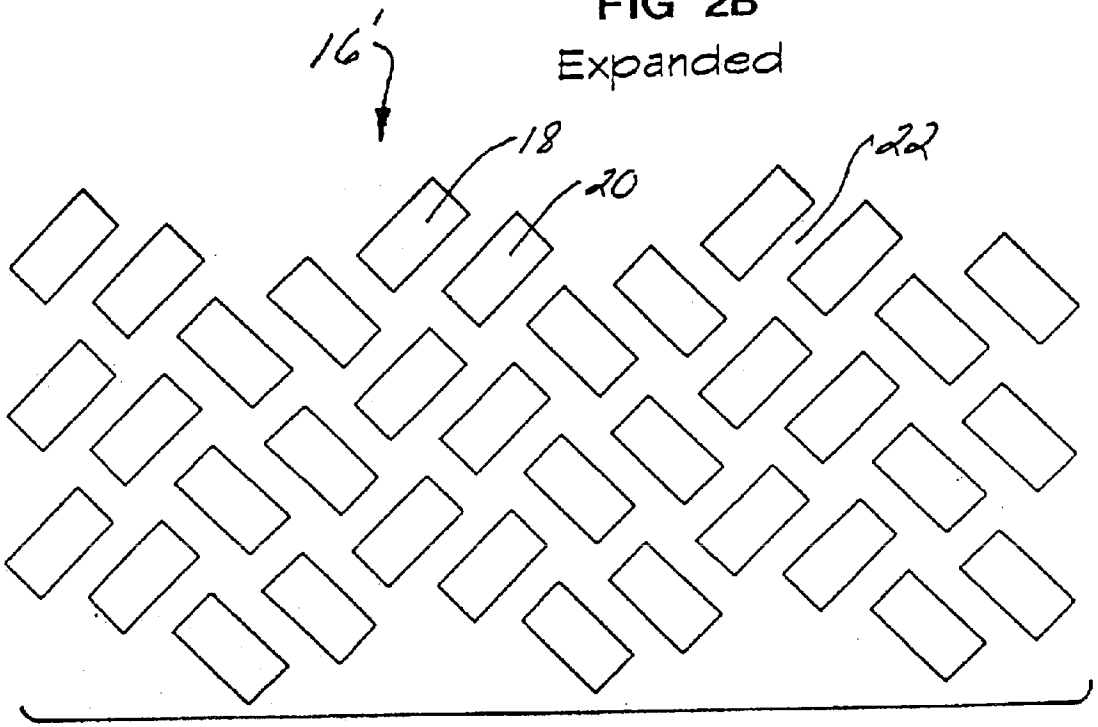
Figure 2A:
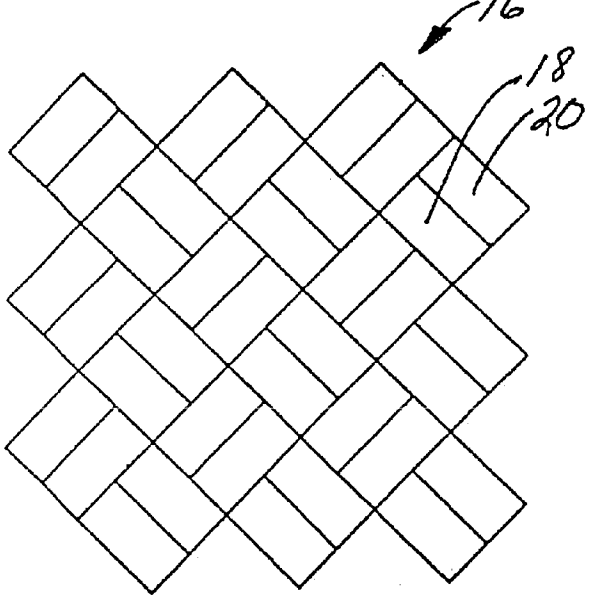
Figure 3B:
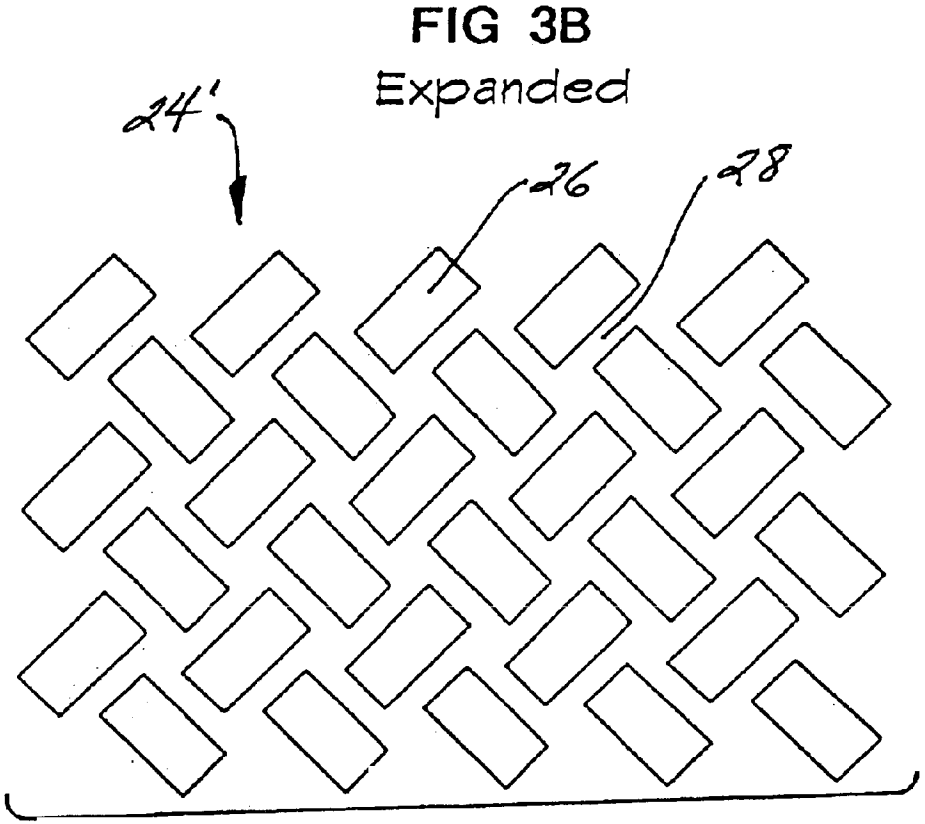
Figure 3A:
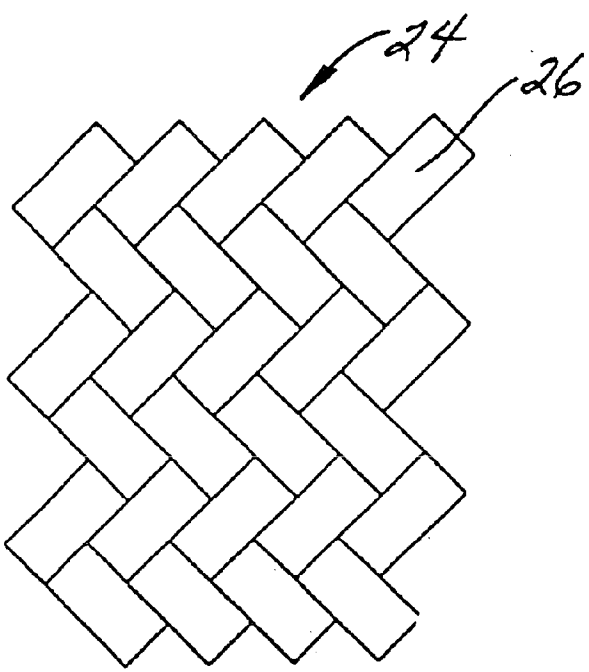
Figure 4B:
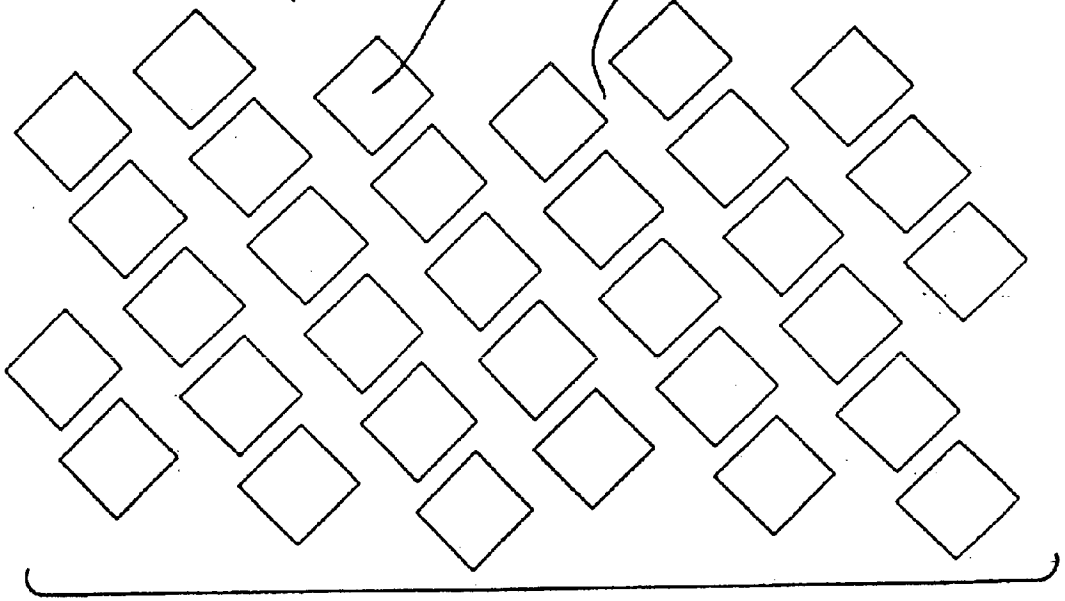
Figure 4A:
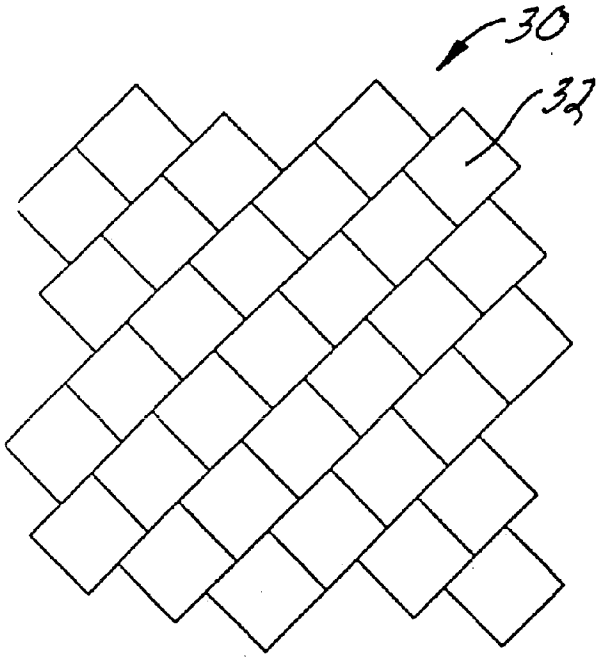
Figure 5B:
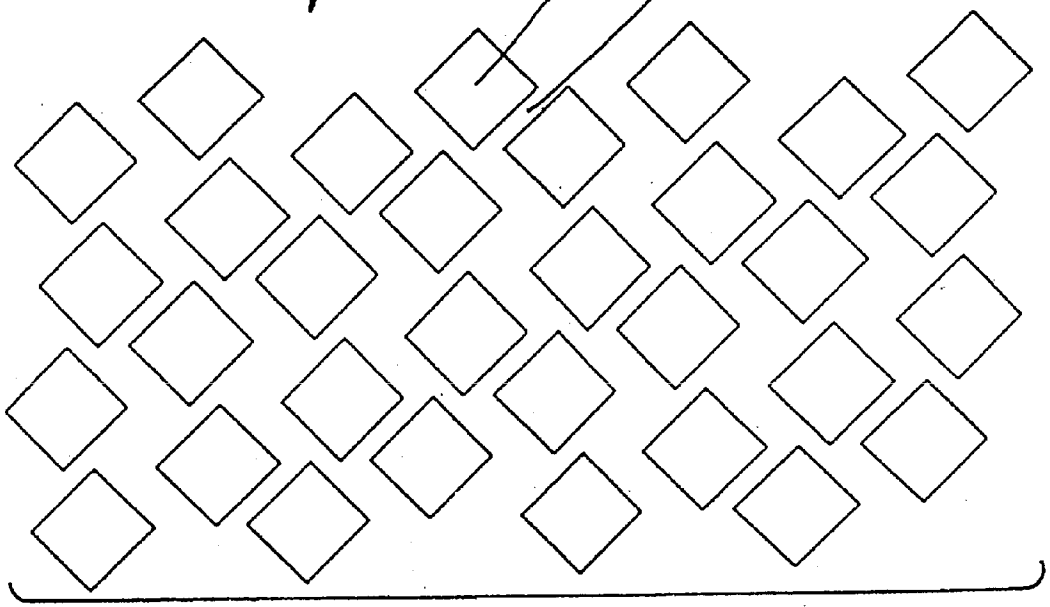
Figure 5A:
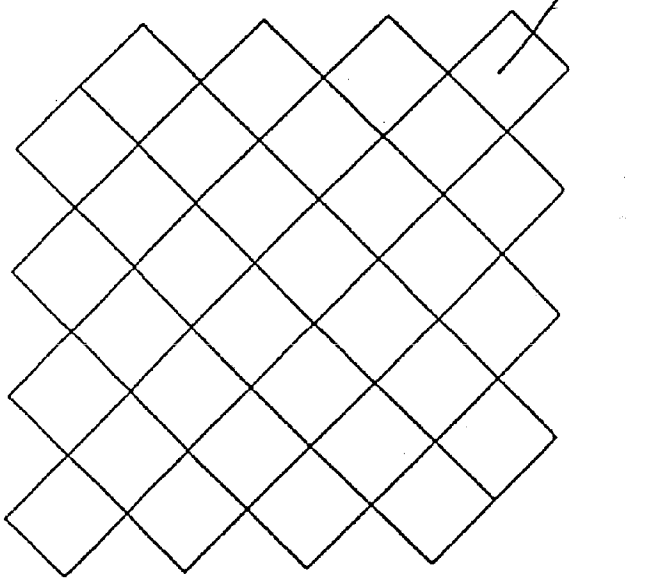

The side and end perimeters of this backing mat 50 are contoured as shown to accommodate the particular tile or brick design array desired and to matably fit adjacent to backing mats. The overall configuration of the backing mat 50 is structured to be compatible with the edges of the contracted tile array shown, for example, in FIG. 1A. These tiles 12 in the tile array 10 of FIG. 1A are individually attached by adhesive or mechanically to the enlarged areas 58*a* and 58*b* of each transversely oriented tile support member 52*a* and 52*b*. These tile support members 52*a* and 52*b* are defined in part by the end and edge perimeter configuration of the backing mat 50 and by each of the transverse slits 60 which are spaced apart and have a zigzag configuration as desired to meet the mounting needs of the closely aligned tile or brick members 72, again directly attached to each of the enlarged tile attachment areas 58*a* and 58*b* evenly spaced along each of the tile support members 52*a* and 52*b*, respectively.

Referring particularly to FIG. 6C and areas A and B in FIGS. 6A and 6B, each of the transverse slits 60 are made up of complete or fully cut segments 60*a* and incomplete segments of cuts formed by overlapping interconnected cuts 54*a* and 54*b* which define an elongated expansion link 54 therebetween. Each of these expansion links 54, when the backing mat 50, as part of assembly 70, are extended lengthwise, serve to maintain the general relationship between each adjacent tile support member 52*a* and 52*b* and also establish a maximum expansion length of each assembly 70 as shown typically in area B of FIG. 6B. By the material selected to form the backing mat 50, various degrees of elasticity in each of the expansion links 54 will add incrementally to the maximum expansion length of the back mat 50 and the degree of contouring as will be described herebelow with respect to FIGS. 7 to 10.

As seen in areas A and B of FIGS. 6A and 6B, a stress relief hole 56 is preferably formed at each proximal end of each of the expansion links 54 so as to reduce the likelihood of tearing or detachment at these intersecting points while each of the assemblies 70 are deployed atop the ground and expanded into the desired plan or top view contour.

Referring now to FIGS. 7 to 10, various ornamental design examples are there shown to depict the versatility of the invention in affording design contour options in forming each of these pathways shown generally at numerals 80, 90, and 100, respectively.

Figure 7:
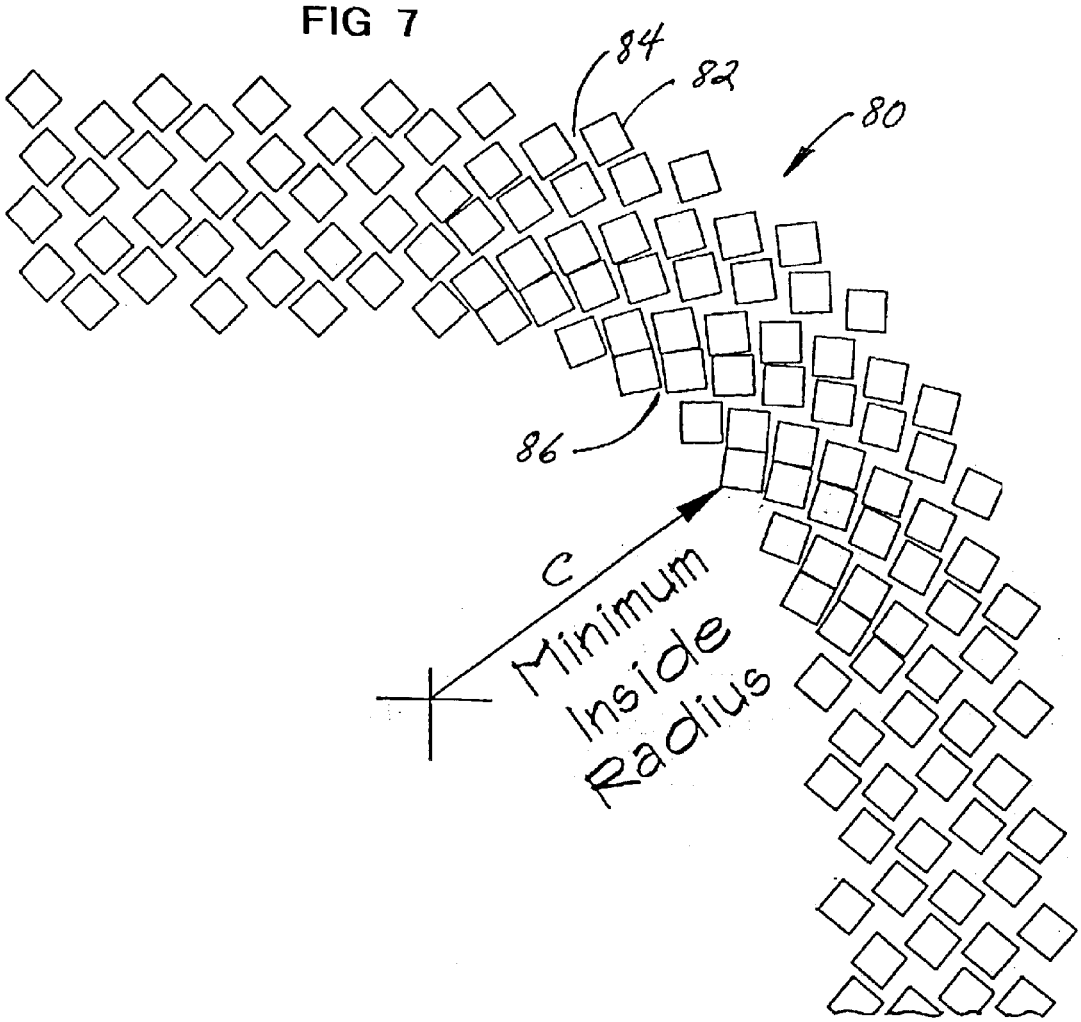
FIGS. 7, 8 and 9 depict a variety of pathways or walkways which have been deployed in various arcuate configurations and degrees of expansion atop a substrate.

In FIG. 7, the pathway 80 (backing mat deleted for clarity) includes a single expanded array of rectangular tiles 82 which are expanded to a maximum gap 84 along the outer periphery of the pathway 80 while gaps 86 along the inner minimum inside radius C are at a minimum radius afforded by this invention. Typically, these gap sizes are in the range of approximately 2" nominally. The overall width of one pathway is typically in the range of about 30" which produces a minimum inside radius in the range of 36" to 40". Where the pathway is in the range of 48", a minimum inside radius of 72" is attainable.

Figure 8:
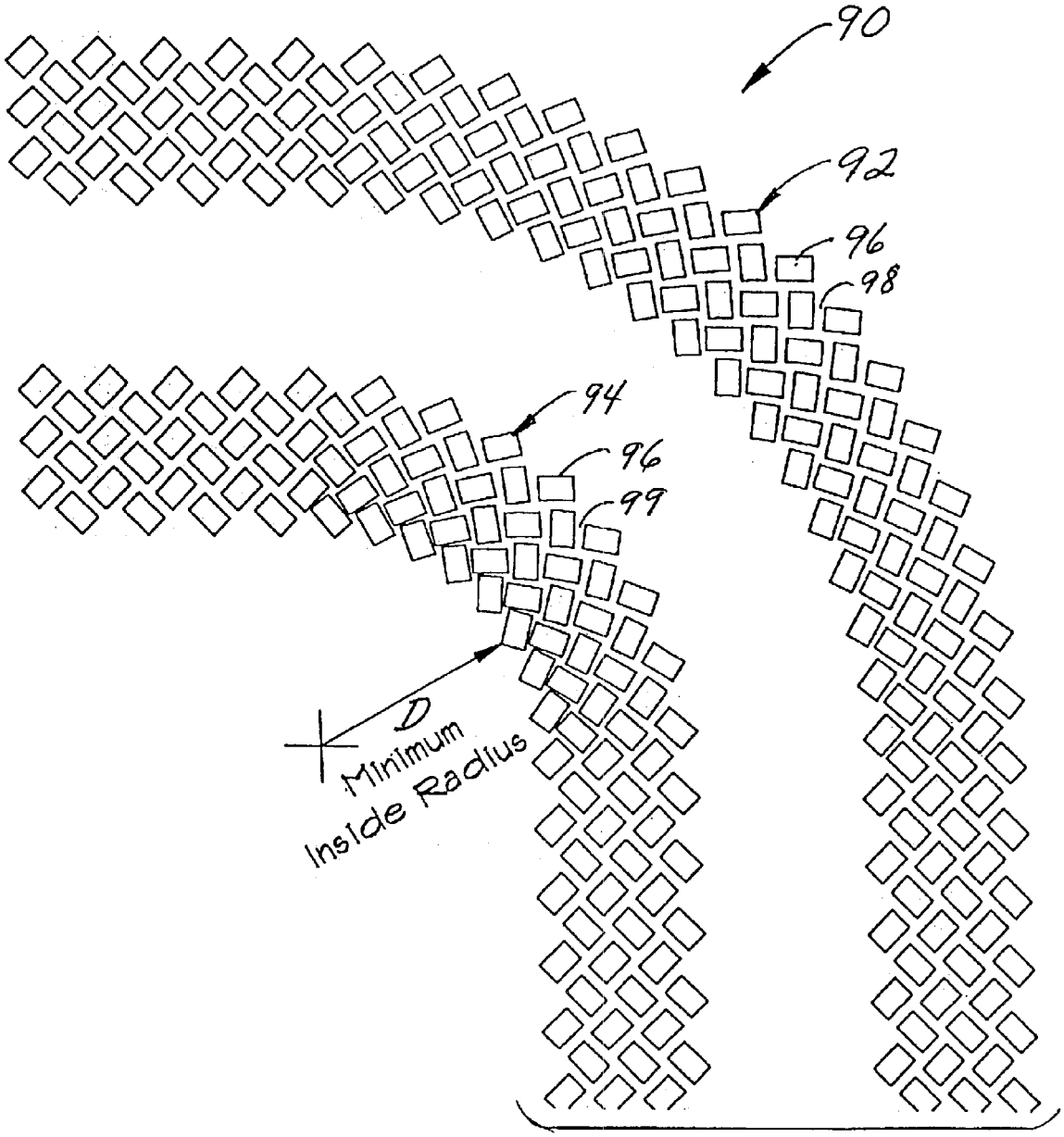

In FIG. 8, a twin pathway arrangement shown at 90 by example provides two separate pathways to support, for example, a golf cart or other lighter weight vehicle which regularly traverses the ground area adjacent a fairway. The inner path 94 and the outer path 92 are cooperatively arcuately deployed in generally parallel fashion, with the minimum radius D on the inside pathway 94 determining the tightest driving radius provided by this pathway arrangement 90.

Figure 9:
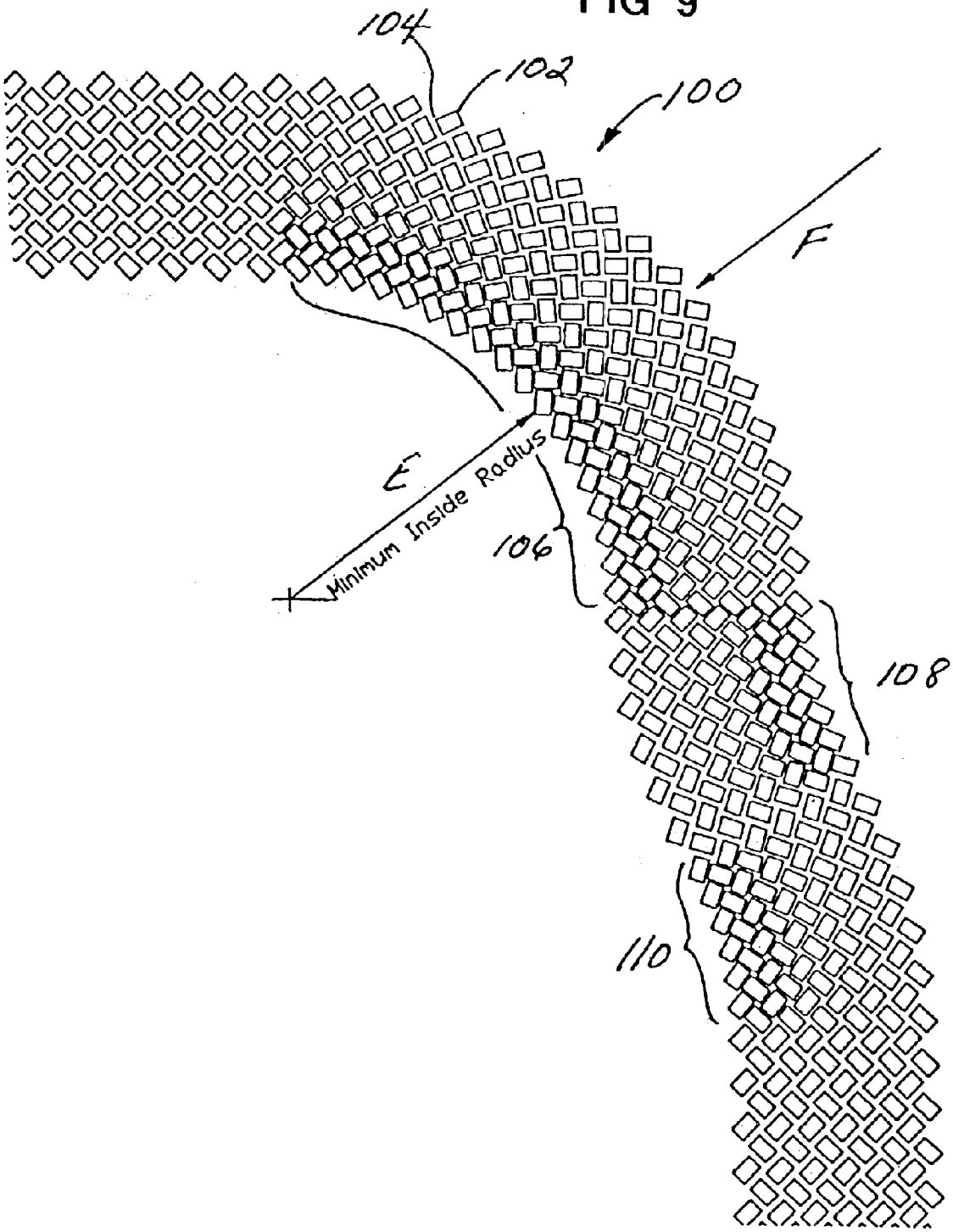

An arcuate pathway 100 is shown in FIG. 9 which incorporates back and forth arcuate segments wherein the inner edge at 106 is expanded minimally between adjacent tiles 102, gap 104 being at a maximum along outer radius F. The inner tiles along 108 in the reverse curve are expanded minimally while the tiles along the inner edge 106 are also expanded minimally to affect the back and forth arcuate travel of this pathway 100.

Figure 10:
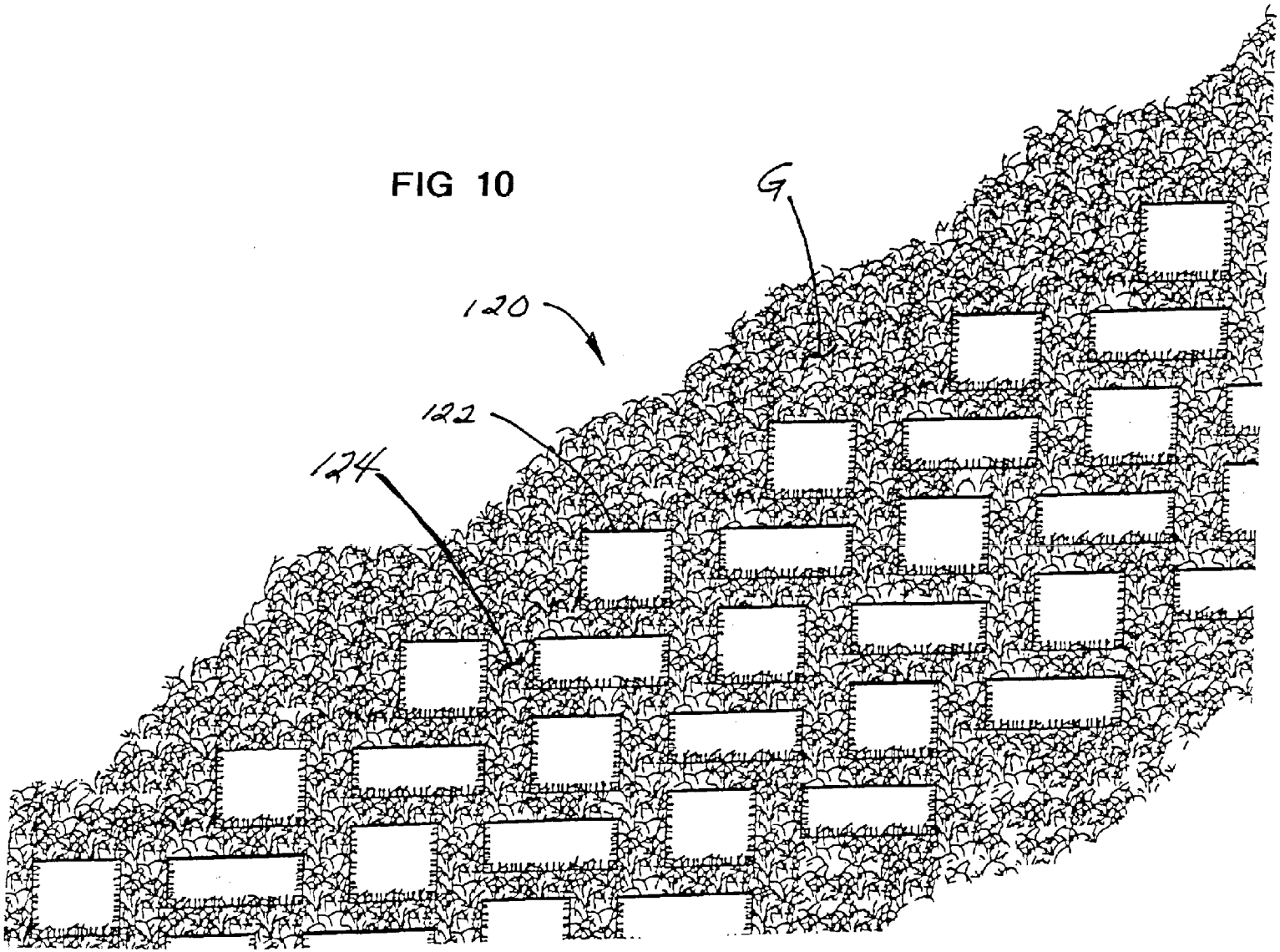
FIG. 10 is a top plan view of another embodiment of the invention depicting growth between individual tile or brick after deployment.

Referring now to FIG. 10, a top plan view of another array of tile 122 is incorporated into the example shown generally at 120. The gaps 124 formed as above described by expanding each of the assemblies 120 in end-to-end arrangement to form the pathway have been either sodded, seeded or allowed to be overgrown and filled with grass G or other ground cover to affect a more aesthetically pleasing pathway 120 than that conventionally attainable by tightly fitted brick or continuous asphalt.

As an alternate to any form of ground preparation which might include the removal of sod or grass, grass along the intended pathway may be initially cut quite short and additionally may be rolled to compact and level the pathway surface. Thereafter, any of the arrays of tile may be deployed as described elsewhere in this specification to follow the chosen pathway. Thereafter, a follow-up rolling of the top surface will help to secure the individual tiles, e.g. at 122, slightly into the ground. It is anticipated that within approximately thirty days, the grass will have sufficiently grown up in between the tiles into that generally shown in FIG. 10. Thereafter, the lateral resistance to movement such as by the turning of a golf cart thereupon will be greatly enhanced and, at some point, each of the individual tiles 122 will become sufficiently permanently secured within the surrounding grass overgrowth so as to completely resist any lateral forces produced by golf carts and even motorized service vehicles.

Figure 11:
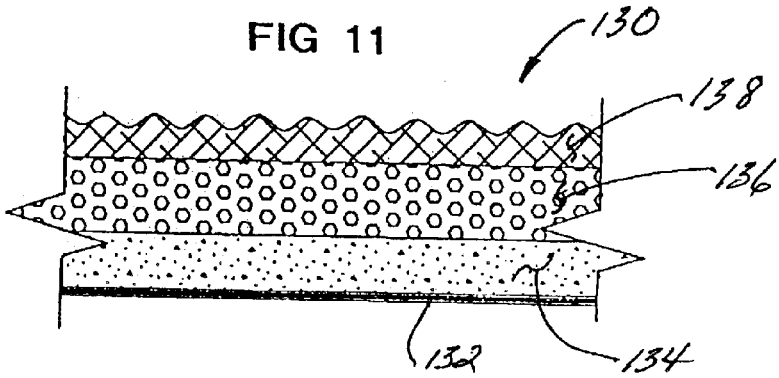
FIG. 11 is a vertical section view through another embodiment of the invention.

A refinement of the invention is shown generally in FIG. 11 at numeral 130. This embodiment 130 is provided to establish a pathway or walkway along the edge of a golf fairway which provides golf ball bounce and roll similar to that of the adjacent natural turf. Where prior art asphalt pathways are utilized, should a golf ball strike thereatop in flight, the bounce is extremely exaggerated and causes the golf ball to travel further after the bounce in an abnormal fashion. Likewise, should a golf ball get into a rolling mode across asphalt, it will obviously travel a much greater distance than if it had begin to roll at the end of flight over grass or turf.

The multi-layer section of each tile and backing mat assembly 130 includes a lower backing mat 132 which is positioned directly atop the ground or substrate in deploying each assembly 130 to form the pathway. A rigid high-density material layer 134 is mechanically or adhesively attached atop the backing mat 132 and is formed of rigid high-density material to create a foundation for load bearing and distribution and adding overall weight to each assembly. A low density, soft cushion material layer 136 with durable, long-lasting resilience is attached adhesively or mechanically or permanently during manufacture atop the foundation layer 134. A final top layer 138 formed of thin, high strength material such as an elastomeric, low nap artificial turf or outdoor carpeting is permanently attached atop the cushion layer 136. By incorporating this arrangement 130 into a golf cart pathway should a golf ball in flight strike the pathway, it will either strike turf which has maturely grown in the gaps between each of the tiles 130 or strike the top layer 138 which, having a low nap artificial turf or outdoor carpeting texturing, will strike and bounce and roll thereover in a fashion similar to that of turf.

Figure 13:
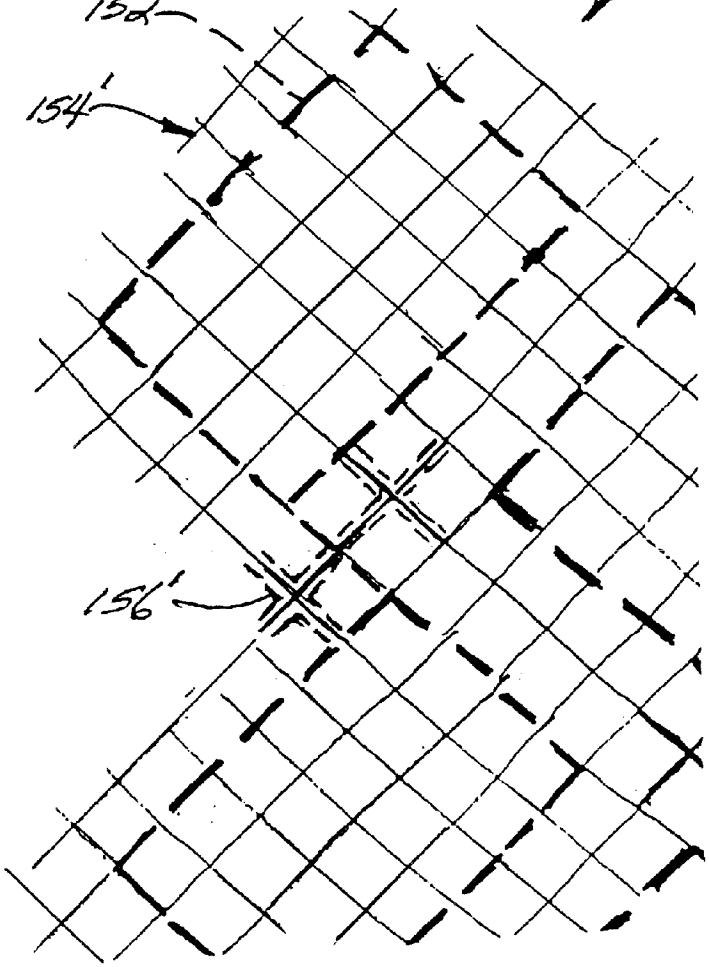
FIG. 13 is a top plan view of the embodiment of the invention shown in FIG. 12 in the expanded orientation.
Figure 12:
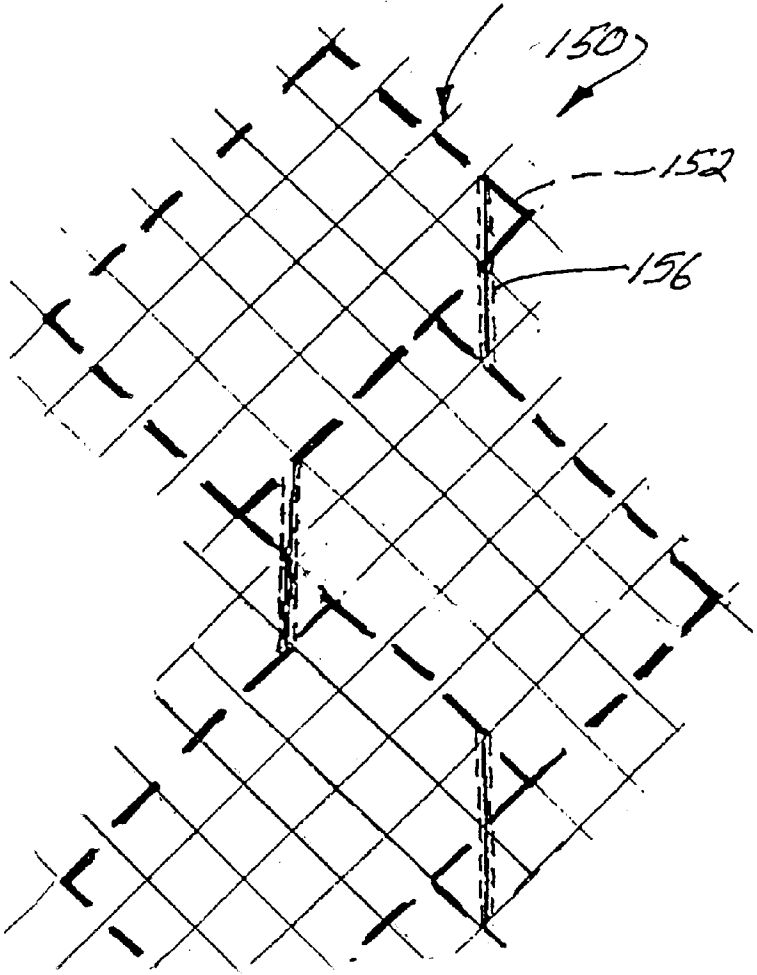
FIG. 12 depicts a top plan view of another decorative embodiment of the invention in the contracted orientation and showing an alternate embodiment of the back mat member.

Referring now to FIGS. 12 and 13, another alternate embodiment of the invention is there shown generally at numeral 150 in the contracted orientation in FIG. 12 and at 150' in the expanded orientation in FIG. 13. Each of the tiles 152 is shown in hidden lines for clarity.

In this embodiment 150/150', the backing member is in the form of a mesh netting formed of either metallic or non-metallic resilient filaments or strands manufactured as a netting sheet. Each of the tiles 152 are mechanically or adhesively connected atop the backing member 154. In the contracted orientation in FIG. 12, excess netting material will be gathered as shown typically at 156. When expanded as shown in FIG. 13, the mesh netting 154' will undergo an expansion of the filaments in the area of 156' to provide the variability in both overall lengthwise expansion of this embodiment 150' and the angular or arcuate deviations from a linear orientation as previously described.

Figure 15:
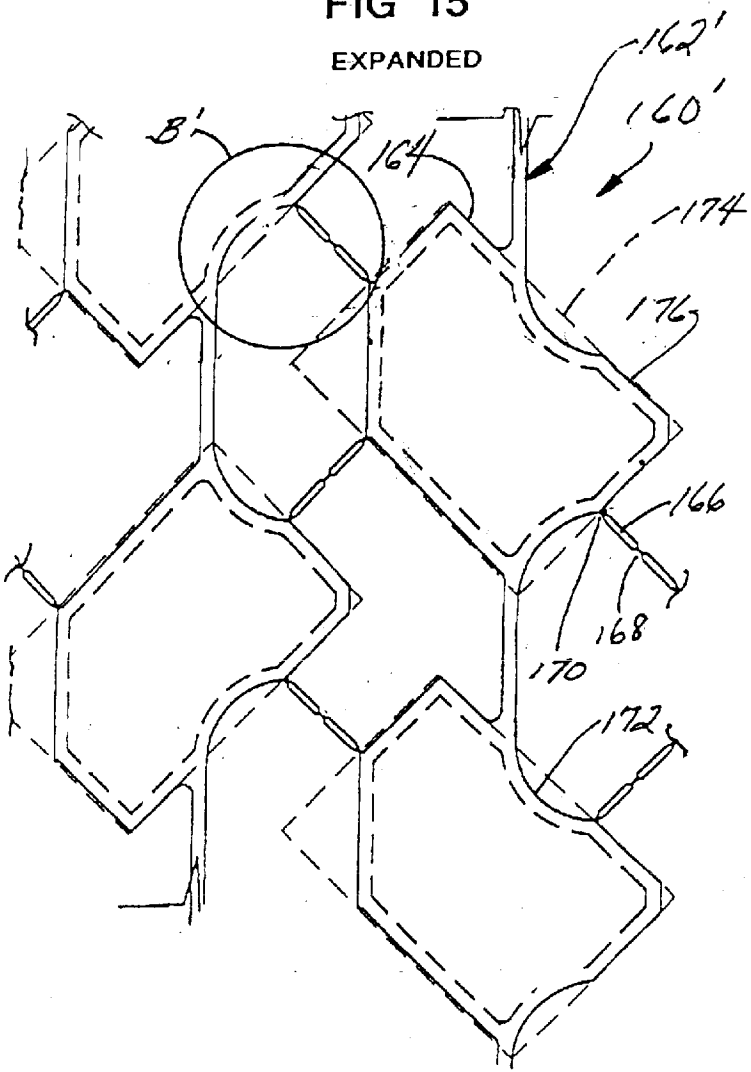
FIG. 15 is a top plan view of the embodiment of the invention shown in FIG. 14 in the expanded orientation.
Figure 14:
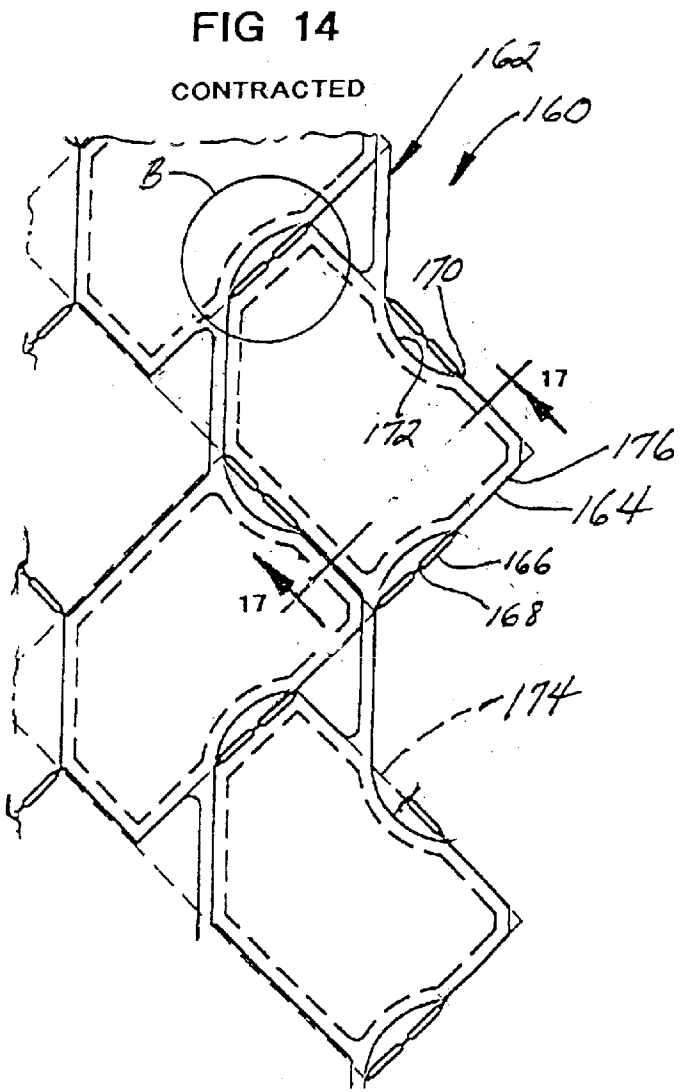
FIG. 14 depicts a top plan view of another decorative embodiment of the invention and showing another alternate embodiment of the back mat member.

Referring now to FIGS. 14 to 20, yet another embodiment of the invention is there shown generally at numeral 160 in the contracted orientation in FIG. 14 and at 160' in the expanded or deployed orientation in FIG. 15. This alternate embodiment 160/160' is directed to a three dimensional backing member 162 which is formed of injection molded plastic as a unit having a series of relatively thin upright wall sections shown typically at numeral 176. This network of wall sections or panels 176 as seen in plan view in FIGS. 14 and 15, define tile engagement areas 164 for adhesive or mechanical attachment of rectangular tiles thereatop as shown in phantom at 174.

Figures 18, 19, 20:
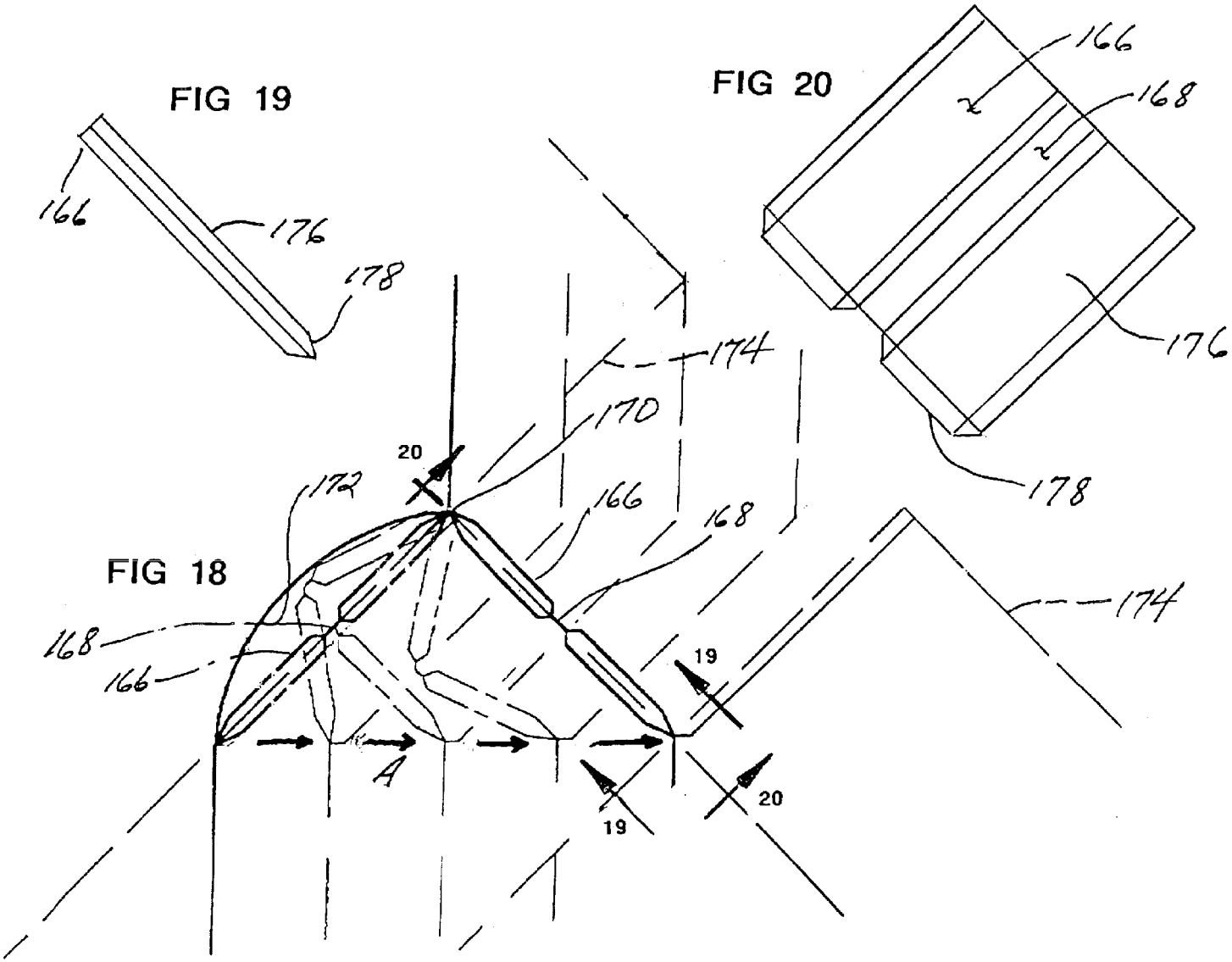
FIG. 18 is an enlargement of area B in FIG. 14 with the expansion link shown in the contracted orientation in phantom combined with area B' of FIG. 15 showing the expansion link in solid in the expanded orientation.
FIG. 19 is a view in the direction of arrows 19—19 in FIG. 18.
FIG. 20 is a view in the direction of arrows 20—20 in FIG. 18.

Articulating expansion links 166 are bendably or pivotally attached at each proximal end thereof shown typically at 170 to adjacent perimeter wall segments 176 by a relatively thin hinge section which, in cooperation with a bendable central thin segment 168, facilitate the articulated movement from the contracted orientation of each of these expansion links 166 as seen in phantom in FIG. 18 to the expanded orientation shown in solid lines.

To avoid the need for further resiliency or deformation of each of these expansion links 166, a concaved clearance cavity 172 is formed into the corresponding wall section of each of the tile attachment areas 164. This provides for the unobstructed articulated movement of each of the expansion links 166 as shown in FIG. 18.

As best seen in FIGS. 16, 19 and 20, the wall sections are vertically elongated so as to penetrate into the soil as the assembly 160' is expanded and deployed atop the ground G. To facilitate this deployment, the distal lower edges 178 of each of the wall sections 176 are tapered or sharpened to facilitate soil penetration. As seen in FIG. 16, the resiliency of the expansion links 166 facilitate full ground engagement atop irregular terrain G of the tiles 174, each of which will fully engage against this irregular terrain G.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A tile and backing assembly comprising:

a backing member formed from a single sheet and having transversely oriented elongated tile support members positioned side by side one to another, each said tile support member being defined by spaced apart transverse slits through said backing member each having complete and incomplete segments and extending in zigzag fashion across a width of said backing member;

each of said incomplete segments defined by overlapping spaced slit segments to define a slender elongated expansion link which connects adjacent tile support members together;

each of said tile support members having evenly spaced tile attachment areas;

a plurality of tiles each one of which is attached to one said tile attachment area in a desired design array with adjacent said tiles abutting one another;

said backing member with said tiles attached thereto being deployable atop a substrate from a contracted orientation to an expanded orientation by pulling end margins thereof apart to expand said backing mat in length up to a limit of length and elasticity of said expansion links whereby said tiles form a desired spaced apart expanded array atop the substrate.

2. A tile and backing assembly comprising:

a backing member formed of a single sheet of flexible material and having a plurality of transverse slits each having a zigzag configuration defining a plurality of tile support members positioned side by side against one another;

a plurality of slender elongated expansion links formed by incomplete and overlapping segments of adjacent said transverse slits which connects adjacent tile support members together;

each of said tile support members having evenly spaced tile attachment areas;

a plurality of tiles each one of which is attached to one said tile attachment area in a desired design array with adjacent said tiles abutting one another;

said backing member being deployable atop a substrate from a contracted orientation wherein adjacent said tiles abut one another in edge-to-edge fashion by pulling end margins thereof apart to expand said backing member in length up to a limit of length a elasticity of said expansion links whereby said tiles form a desired spaced apart expanded array of tile atop the substrate.

3. A tile and backing assembly as set forth in claim 2, wherein:

each of said expansion links are pivotally attached at each end thereof to adjacent said tile support members and include a thin, bendable mid point thereof;

each of said tile support members to which one end of one said expansion link is pivotally attached is arcuately concave to provide clearance for articulated movement of each of said expansion links as said assembly is stretched and deployed atop the ground.

4. A tile and backing assembly as set forth in claim 3, wherein:

a lower margin of each of said tile support members is sharpened for easier ground penetration thereby when said assembly is deployed.

* * * * *